US005960680A

United States Patent [19]

Chen et al.

[11] Patent Number: 5,960,680

[45] Date of Patent: Oct. 5, 1999

[54] RATCHET WRENCH

[76] Inventors: Chyn-Huei Chen; Shiou-Yih Chen, both of No. 111, Lane 699, Kuang Hsin Road, Taiping City, Taichung, Hsien, Taiwan

[21] Appl. No.: 08/951,764

[22] Filed: Oct. 16, 1997

[51] Int. Cl.[6] ..... B25B 13/46

[52] U.S. Cl. ..... 81/63.2; 81/60

[58] Field of Search ..... 81/63, 63.1, 63.2, 81/62, 61

[56] References Cited

U.S. PATENT DOCUMENTS 3,783,703 1/1974 Trimble et al. ..... 74/157
5,012,705 5/1991 Chow ..... 81/63

*Primary Examiner*—David A. Scherbel
*Assistant Examiner*—Philip J. Hoffmann
*Attorney, Agent, or Firm*—Rosenberg, Klein & Bilker

[57] ABSTRACT

A ratchet wrench is provided that includes a link control structure in which the control rod slides smoothly in the D-head to control the ball that locks the joint with a socket or releases the joint. A new bolting joint structure between the D-head and the reversing disc is provided that consists of a straight segment at the front portion, as a guiding section, and a conic segment at the back portion, as a securing section of the threaded trunk, so that the bolt can be located at any desired position for adjustment, without the possibility of loosening. The reversing disc has a curved circular groove formed in the top surface thereof that conforms to human engineering principles.

5 Claims, 15 Drawing Sheets

222
22
24

25
21
223
24
26
224

224
223
23
222
22
26
2
21
214
211
27
25
24
241
242

RATCHET WRENCH

BACKGROUND OF THE INVENTION

1. Field of the Invention

The present invention relates to a ratchet wrench, and more particularly to an assembled structure of the ratchet wrench which provides improved anti-uncoupling effects to make the wrench operate smoothly and integrally.

2. Prior Art

In accordance with the conventional ratchet wrench 10, as shown in FIG. 1, there is a containing hole 111 on a side of the plug joint portion 110 of the D-head 11 for housing a spring 112 and a ball 113. The ball 113 is located so that a portion thereof extends out from the mouth of the containing hole 111 at the side of the plug joint portion 110. The extending portion of the ball 113 elastically slides into a recess 122 of the socket 121 as the plug joint portion 110 is inserted into the socket 121 of a link rod 12 forming an elastic joint for preventing the link of the plug joint portion 110 and the link rod 12 from uncoupling. But, when the weight of a link rod 12 of larger size is so great as to override the backing force exerted on the back of the ball 113, or the ratchet wrench 10 is turned too fiercely, the ball 113 may be pressed inward to compress the spring 112 so that the link rod 12 uncouples with the plug joint portion 110 of the D-head 11. To overcome that problem, a manually displaceable ball 214 in a locking or releasing ratchet wrench, as shown in FIG. 2 and FIG. 3, was marketed later. The D-head 21 of the ratchet wrench 2 has a through-hole 210 formed axially through the center to connect with the containing hole 212 of the plug joint portion 211. The reversing disc 22 has a stepped central hole 221 with a larger diameter containing hole 222 formed in correspondence with the through-hole 210 for inserting a control rod 24 with a spring 23 therein. A tenon 223 is built upon the bottom side of the reversing disc 22. The control rod 24 has a ball seat 241 with a beveled push face 242 adjacent the bottom end thereof, corresponding to the containing hole 212 on the plug joint portion 211. The ball 214 is maintained in the containing hole 212 by punching a flange on the outer rim of the mouth of the hole 212 inwardly to prevent the ball 214 from falling out.

The tenon 223 on the bottom side of the reversing disc 22 is used to contact the top face of the D-head 21 for maintaining a space between them so that a cardioid spring 25 can move in that space freely along with the movement shift pin 224 of the reversing disc 22. When turning the reversing disc 22 to move the cardioid spring 25, one side of the cardioid spring 25 presses the tenon 223, as shown in FIG. 2, FIG. 3A and FIG. 3B, so that the reversing disc 22 is displaced to press the control rod 24 laterally and eccentrically with a side of the central hole 221, to cause the control rod 24 to hardly be able to slide in it due to high friction, even to bring about a locking-up phenomenon.

On the other hand, in assembling the control rod 24, the reversing disc 22, the cardioid spring 25, the loose ratchet 26 and so on, these need to be mounted at the same time, increasing the complexity of the installation. The loose ratchet 26 and the cardioid spring 25 are located in place, then the reversing disc 22 is installed by putting the shift pin 224 into the closed end of the cardioid spring 25, and twisting the reversing disc 22 to deform the cardioid spring 25 so that the central hole 222 overlaps on the through-hole 210 of the D-head 21, in order to plug the control rod 24 and the spring 23 in the holes 222 and 210. Finally, the ball 214 is retained in the containing hole 212 of the plug joint portion 211 and disposed in the ball seat 241 by punching a flange at the outer rim of the mouth of the containing hole 212 inwardly, to assemble the impelling head 20. Because installing the control rod 24 is so complex, especially to locate the cardioid spring 25, the installation of the impelling head is difficult and has high production cost. On the other hand, for retaining the impelling head 20, a snap ring 27 clamps on the ring groove 213 of the plug joint portion 211 of the D-head 21. Between the snap ring 27 and the head portion 2 there is a gap C. Due to the existence of the gap C, the impelling head 20 will sway. The gap C may be enlarged or reduced by machining errors. If the gap C is too small, the impelling head 20 will be clamped down. If the gap C is enlarged, the bigger the gap C is, the greater the shake of the impelling head 20 is, so that the percentage of defective wrenches is quite high. Therefore, controlling the size of the gap C has become a technical bottle-neck for manufacturers. And the reversing disc 22 of the impelling head 20 has a conic top face, as shown in FIG. 4, for pushing to turn the impelling disc 20 with he thumb of the user. But because the contacting surface of the reversing disc 22 is so slippery, the user has to exert a much greater force on the tip of the thumb in order to rotate the reversing disc 22.

Referring to FIG. 5, FIG. 6, FIG. 6A and FIG. 6B, another kind of conventional ratchet wrench is shown, in which the head portion 310 of the wrench 31 has many axial teeth 311 arranged on the inside wall. The D-head 32, the loose ratchet 33 and the cardioid spring 34 are mounted into the head portion 310 from one end. The reversing disc 35 is mounted from the other end so that the shift pin 351 at the bottom side of the reversing disc 35 inserts into the closed end of the cardioid spring 34. Then, the reversing disc 35 is secured to the D-head 32 to saddle the head portion 310 by a screw 37 and a washer 36. In this case, the D-head 32 and the reversing disc 35 cannot contact the head portion 310, otherwise they could not rotate in the head portion 310. As shown in FIG. 6A and FIG. 6B, a proper gap C has to be maintained between the D-head 32 or the reversing disc 35 and the head portion 310 respectively, and the size of the gap C is controlled by adjusting the bolt 37. Therefore, the bolt 37 has to be in a loose state for that purpose. In order to locate the bolt 37 in place and prevent it from loosening, the manufacturers usually employ one of the following methods:

1. Coating a Teflon layer on the outer surface of the bolt 37 to increase the tightness of the threaded connection, but it cannot retain the bolt 37 at a set tightness, especially in response to beating, colliding or falling down to the ground. The coated bolt 37 still loosens, or after undergoing adjustment many times, the Teflon layer on the coated bolt 37 peels off, losing the tightness effect.

2. Applying a bonding agent on the threaded section, a portion of the bonding agent will spread out to other places, to adhere to other parts like the cardioid spring 34, or the D-head 32 and the reversing disc 35, so that they cannot move normally. Once the bolt 37 is loosened from the bonding joint by striking during use, or during adjustment of the gap C, it requires the user to take care in loosening bolt 37, with frequent checks to prevent the gap C from becoming too great.

On the other side, for increasing the contacting area, the conic top surface of the reversing disc 35 is treated to have a roughened surface for increasing friction, but it stall requires the user to exert a high pressing force on the surface to distort the user's thumb for increasing the contacting area to assist in rotating the reversing disc 35. If carried out many times, under this state, the user's thumb will feel pain and become tired.

SUMMARY OF THE INVENTION

It is therefore a main object of the present invention to provide a D head structure that can be installed rapidly and simply.

It is another object of the present invention to provide a link control structure in which the control rod slides smoothly in the D-head without any blocking.

It is yet another object of the present invention to provide a new bolting joint structure between the D-head and the reversing disc that consists of a straight segment at a front portion as a guiding section and a conic segment at the back portion as a securing section on the threaded trunk so that the bolt can be located at any desired position to provide adjustment without the possibility of loosening and coming off.

DETAILED DESCRIPTION OF PREFERRED EMBODIMENTS

Figure 1:
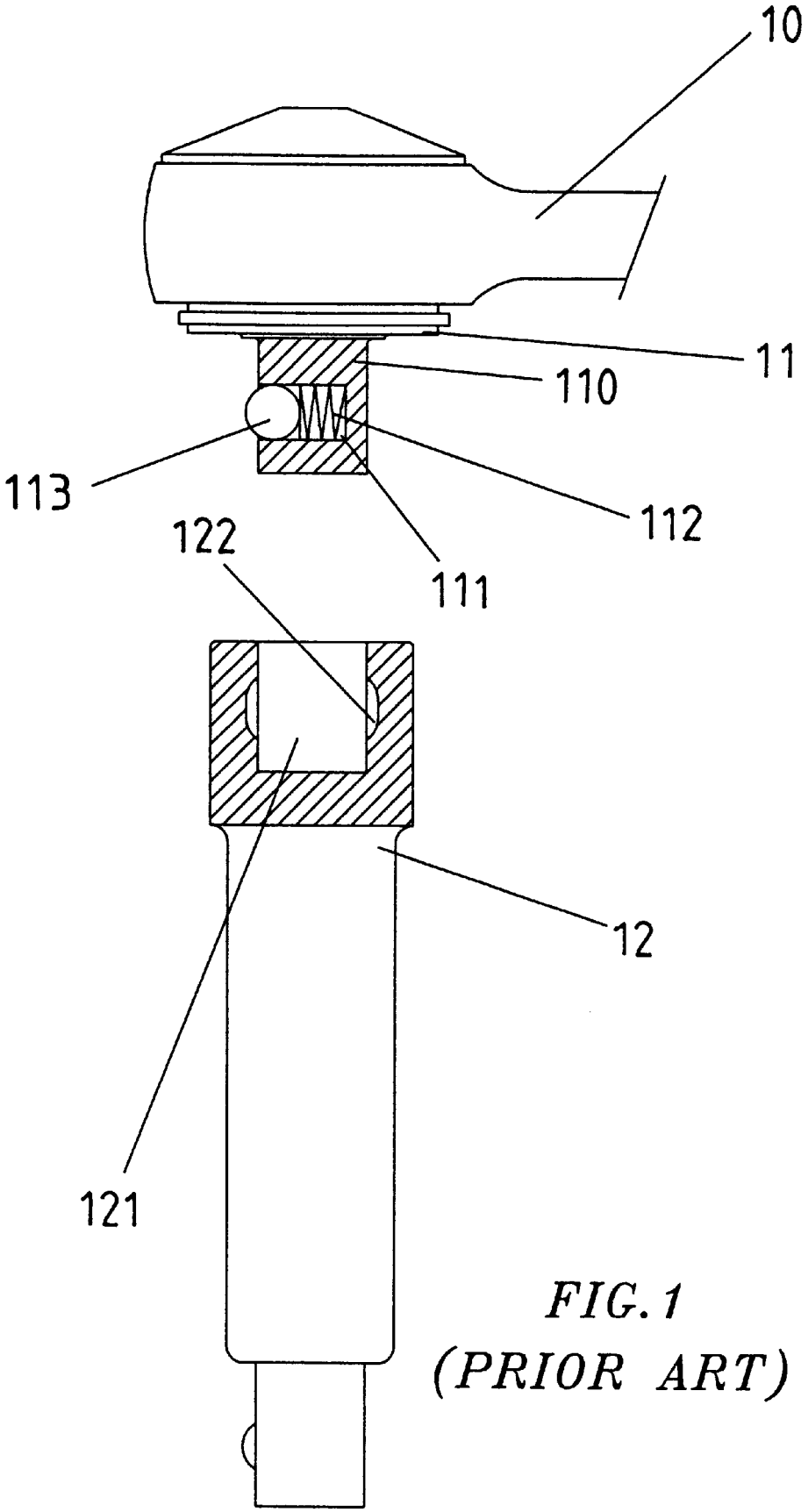
FIG. 1 (PRIOR ART)
FIG. 1 is a side view of a prior art ratchet wrench.
Figure 2:
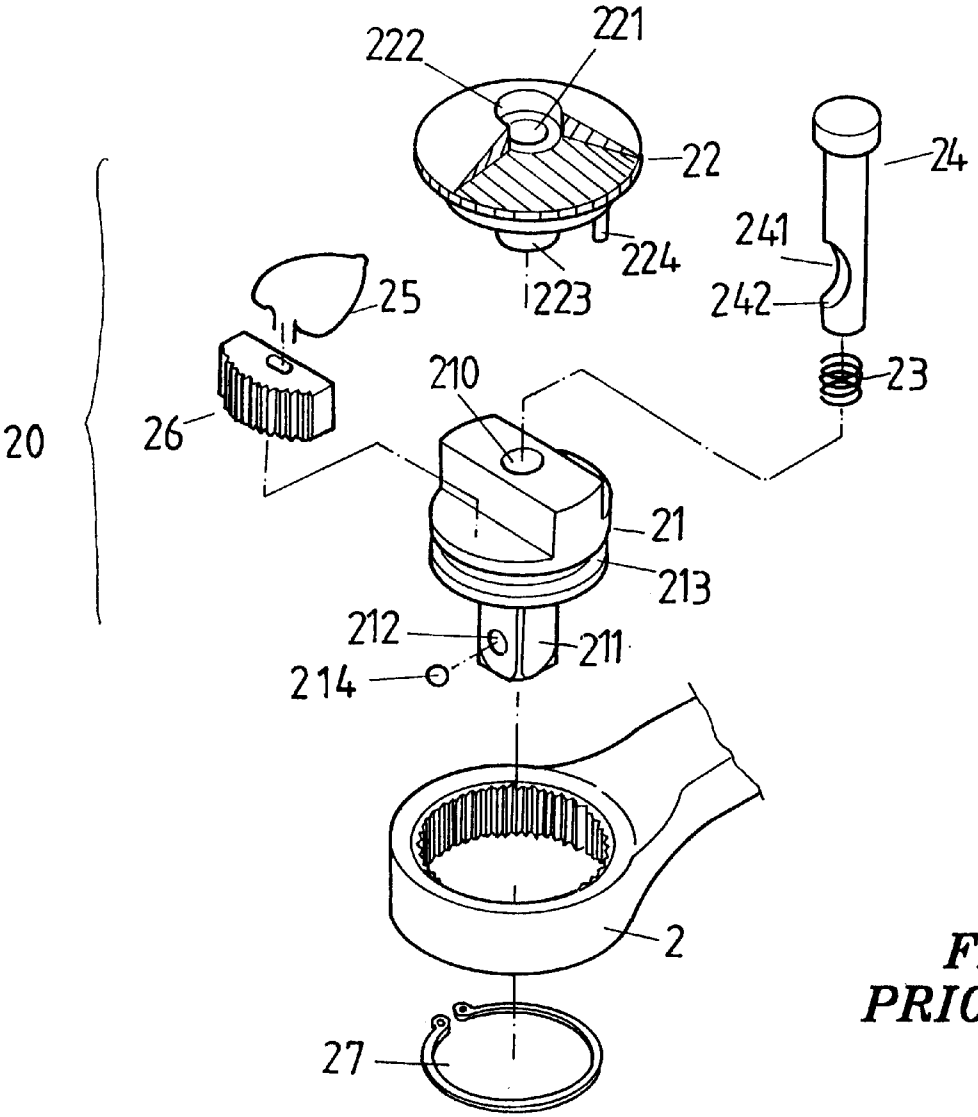
FIG. 2 PRIOR ART
FIG. 2 is an exploded view of another prior art ratchet wrench.
Figures 3, 3A, 3B:
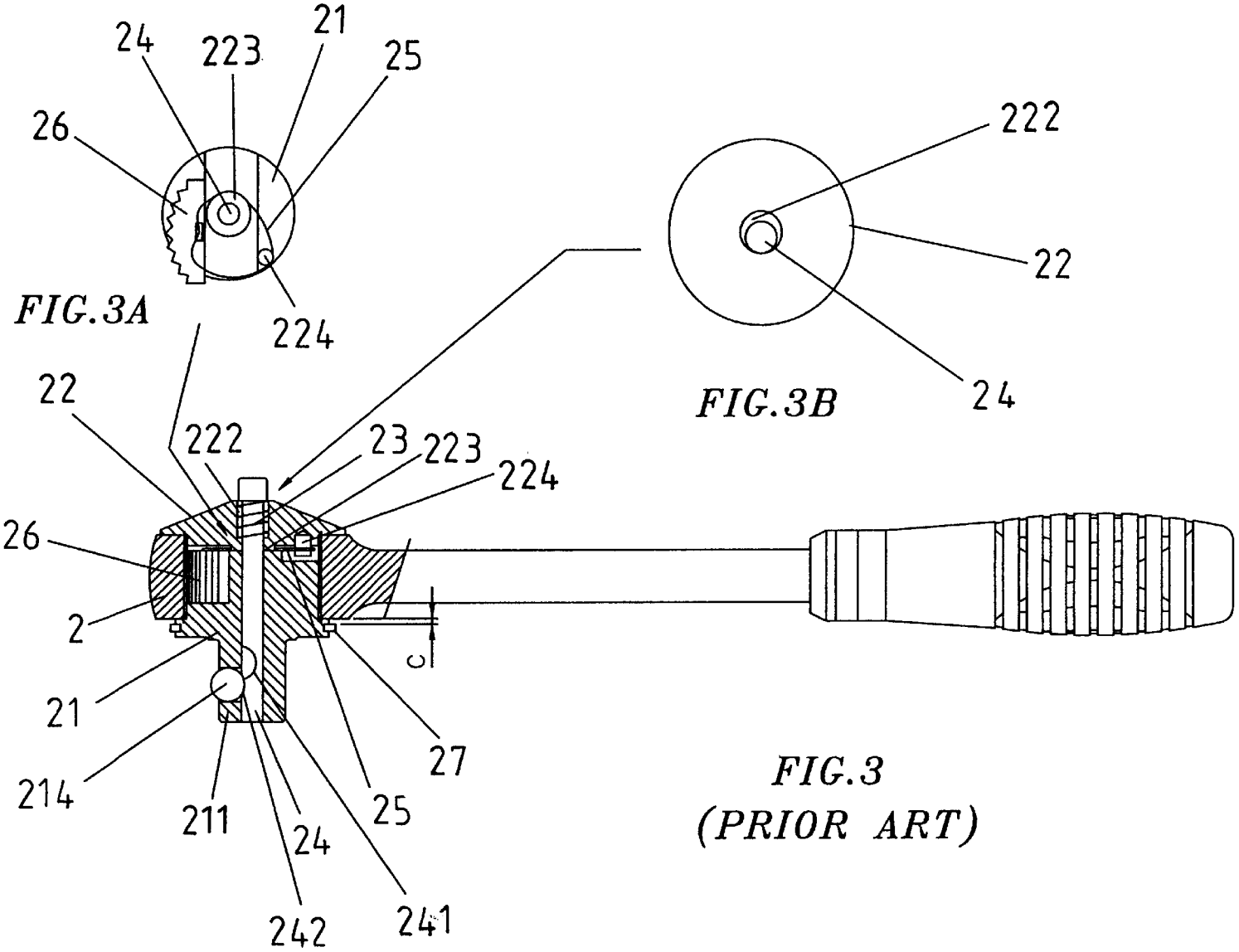
FIG.3 (PRIOR ART)
FIG. 3 is a partially sectioned view of the prior art ratchet wrench of FIG. 2.
FIG. 3A and FIG. 3B are enlarged views of portions of FIG. 3.
Figure 4:
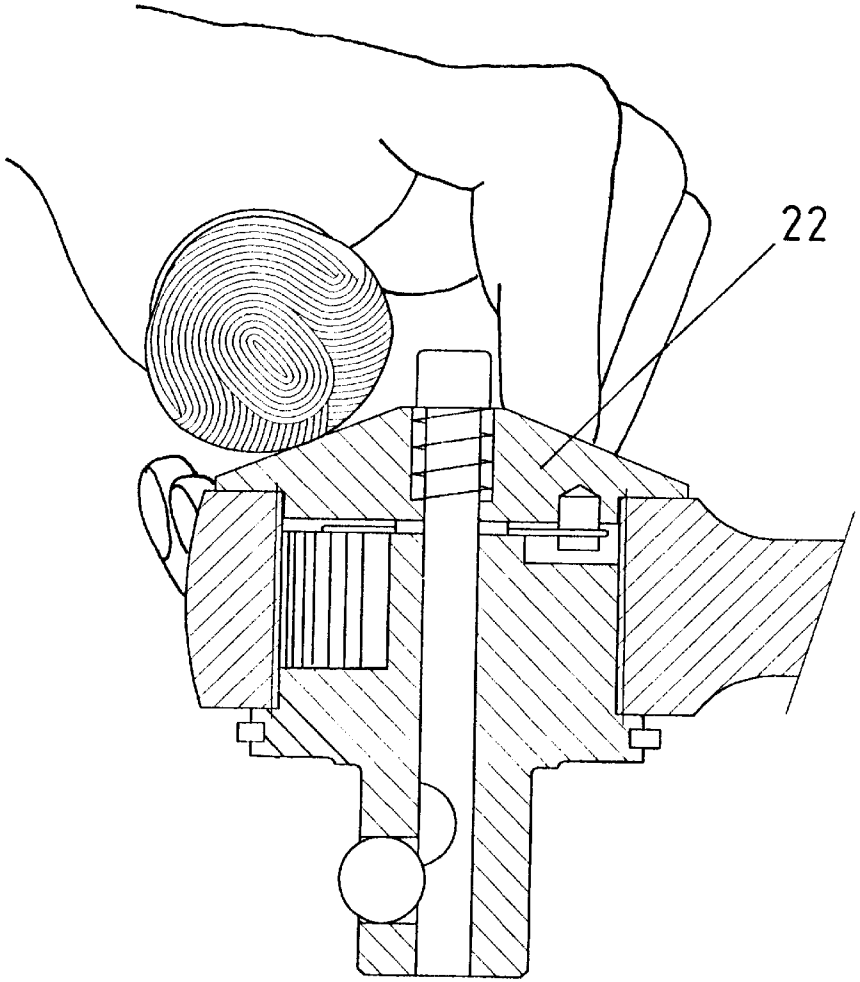
FIG. 4 PRIOR ART
FIG. 4 is a cross-section view showing use of the prior art ratchet wrench of FIG. 2.

Referring to FIG. 7, FIG. 8, FIG. 8A and FIG. 8B, the present invention provides an impelling head, in which a set of teeth 311 are formed axially in the inside wall of a head portion 310. A D-head 40 is mounted into the head portion 310 from one end. On the inner side of the D-head 40, a loose ratchet 41 is attached on one side. The loose ratchet 41 has a slotted hole 411 formed in the top side thereof, for retaining a pair of extension legs 421 of a cardioid spring 42. On another side of the head portion 310, a reversing disc 50 is installed.

The D-head 40 has a threaded portion 43 extending a proper length therefrom. The threaded portion 43 has a stepped center hole 442 and a bigger diameter hole 441 at the top end for receiving a spring 44 and a shouldered control rod 45. The control rod 45 has a concave push face 451 connecting to a deeper ball seat 452, corresponding to a ball housing 461 on a plug joint portion 46. By punching the mouth of the ball housing 461 inwardly, a ball 453 is maintained therein, and clampingly engaging the push face 451 under a bias force of the spring 44 pushing the shouldered control rod 45 in the hole 442.

The reversing disc 50 has a shouldered center through hole 51 for passage of threaded portion 43 of the D-head 40 therethrough. A round nut 53 disposed in hole 51 is secured to the threaded portion 43. The shoulder hole 51 is slightly bigger than the threaded portion 43 of the D-head 40 so that the shift pin 52 at the bottom side of the reversing disc 50 can be inserted into the closed end of the cardioid spring 42. On one end of the control rod 45, there is an elastic cap 54 secured thereto for increasing the contact area to be pushed with a finger of the user. In accordance with human engineering, a curved circular groove 55 is formed on the top surface of the reversing disc 50 and treated with a deep knurling to increase the contacting area with the thumb of the user.

The present invention has improvements as follows:

1. Retaining mechanism controlled by the control rod: referring to FIG. 8, FIG. 8A, FIG. 8B and FIG. 9, the ball 453 is pushed by the control rod 45 with he push face 451 to prevent the ball 453 from moving back into the ball housing 461. When linking with a joint socket, the cap 54 is pushed to move the control rod 45 down so that the ball 453 slides into the ball seat 452, wherein the ball 453 can be fully withdrawn into the ball housing 461, as the plug joint portion 46 is inserted into the joint socket. Release of the control rod 45, under the restoring force of the spring 44, causes the control rod 45 to move up and to push the ball 453 out the ball seat 461 until the ball 453 slides on the push face 451, so that the ball 453 clampingly engages the recess of the joint socket, forming a locking state.

2. Adjusting the gap C: referring to FIG. 8, FIG. 8A and FIG. 8B, by means of adjusting the position of the round nut 53 on the threaded portion 43 of the D-head 40, the gap C between the D-head 40 or the reversing disc 50 and the head portion 310 can be controlled in a desired value so as to prevent the D-head 40 and the reversing disc 50 from swaying in the head portion 310. Subsequently, a bonding agent is inserted into the space between the round nut 53 and the threaded portion 43 to affix one to the other. A tapered thread can be formed on the round nut 53 or the threaded portion 43 to prevent the threaded joint from loosening.

3. Combining rapidly and simply: referring to FIG. 7, FIG. 8, FIG. 8A and FIG. 8B, due to the mounting of control rod 45 into the D-head 40, the assembly is easy and simple, without concern as to an interference developing between the control rod 45 and the other parts.

4. Smoothly sliding the control rod: for the same reason as mentioned in item 3, the control rod can slide in the D-head 40 smoothly without any interference from the outside.

5. Conforming to human engineering: referring to FIG. 8 to FIG. 11, in accordance with the arc of a user's thumb, for increasing the contacting area of the top surface of the reversing disc, the reversing disc being designed with a curved circular groove 55 with knurling formed on it to generate enough friction when being pushed with the user's thumb only, or when both the thumb and the forefinger of the user are used.

Figure 5:
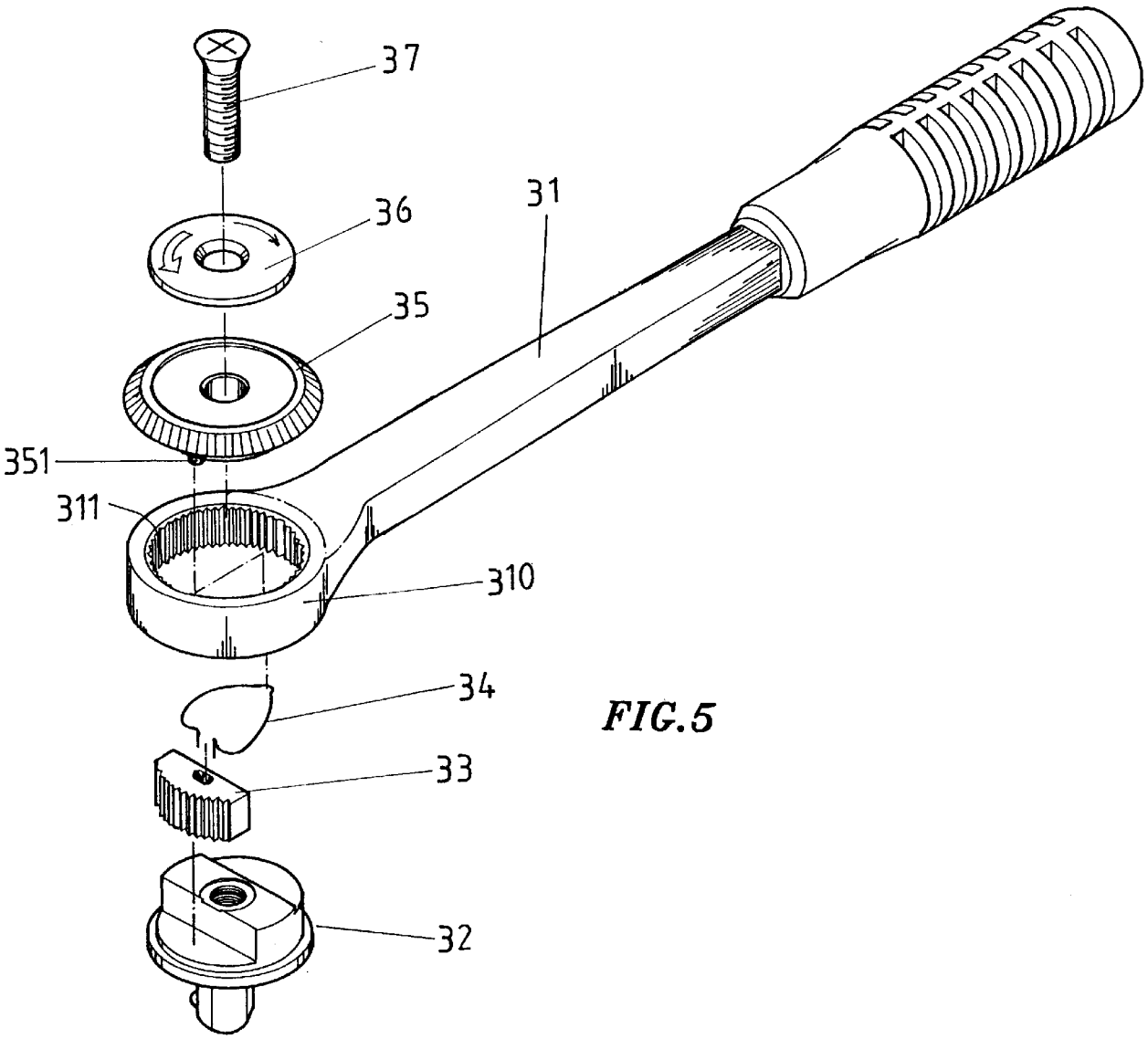
FIG. 5 is an exploded view of a further prior art ratchet wrench.
Figures 6, 6A, 6B:
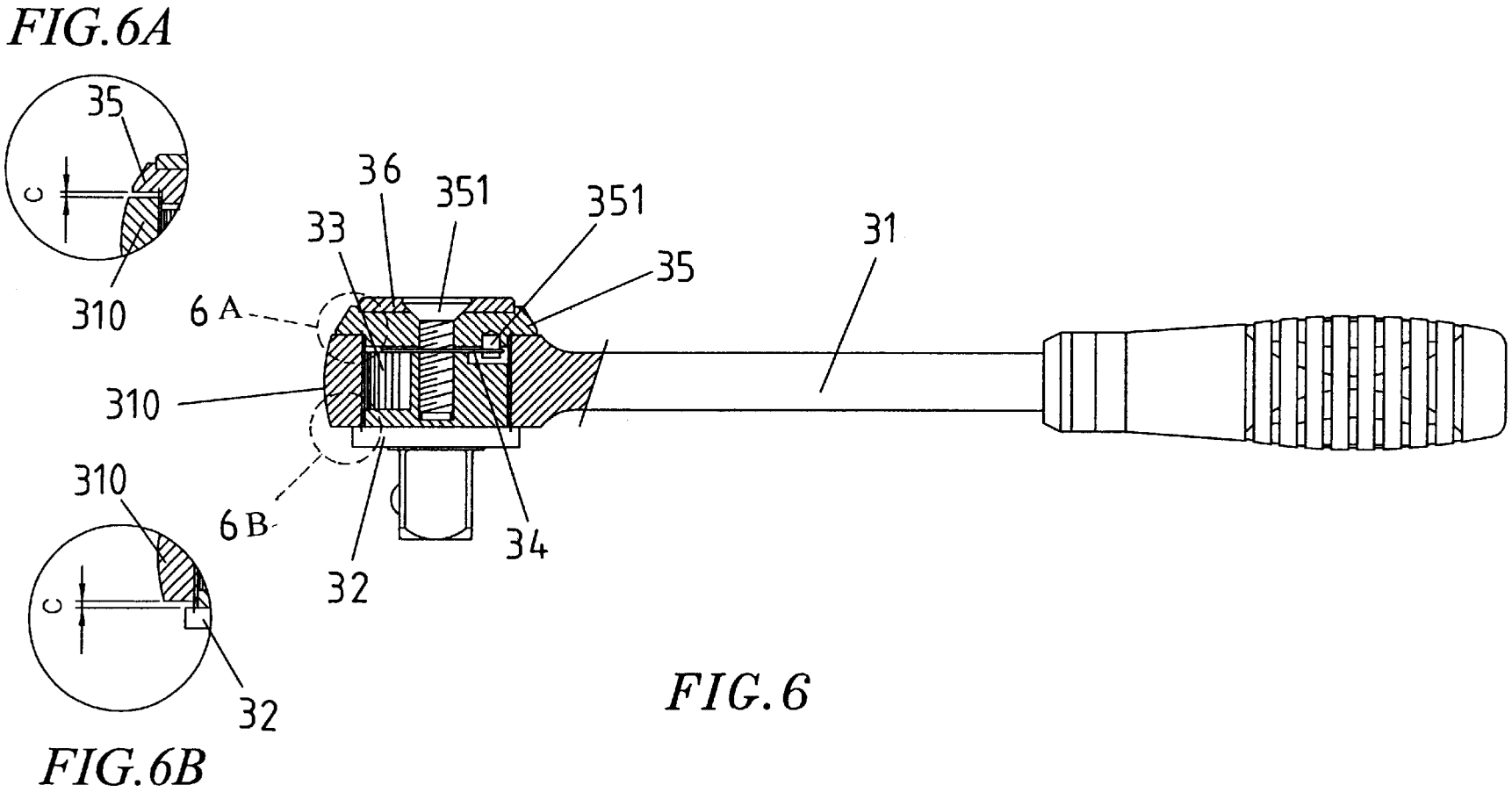
FIG. 6 is a partially sectioned view showing the assembly of the wrench of FIG. 5.
FIG. 6A and FIG. 6B are enlarged views of portions of FIG. 6.
Figure 7:
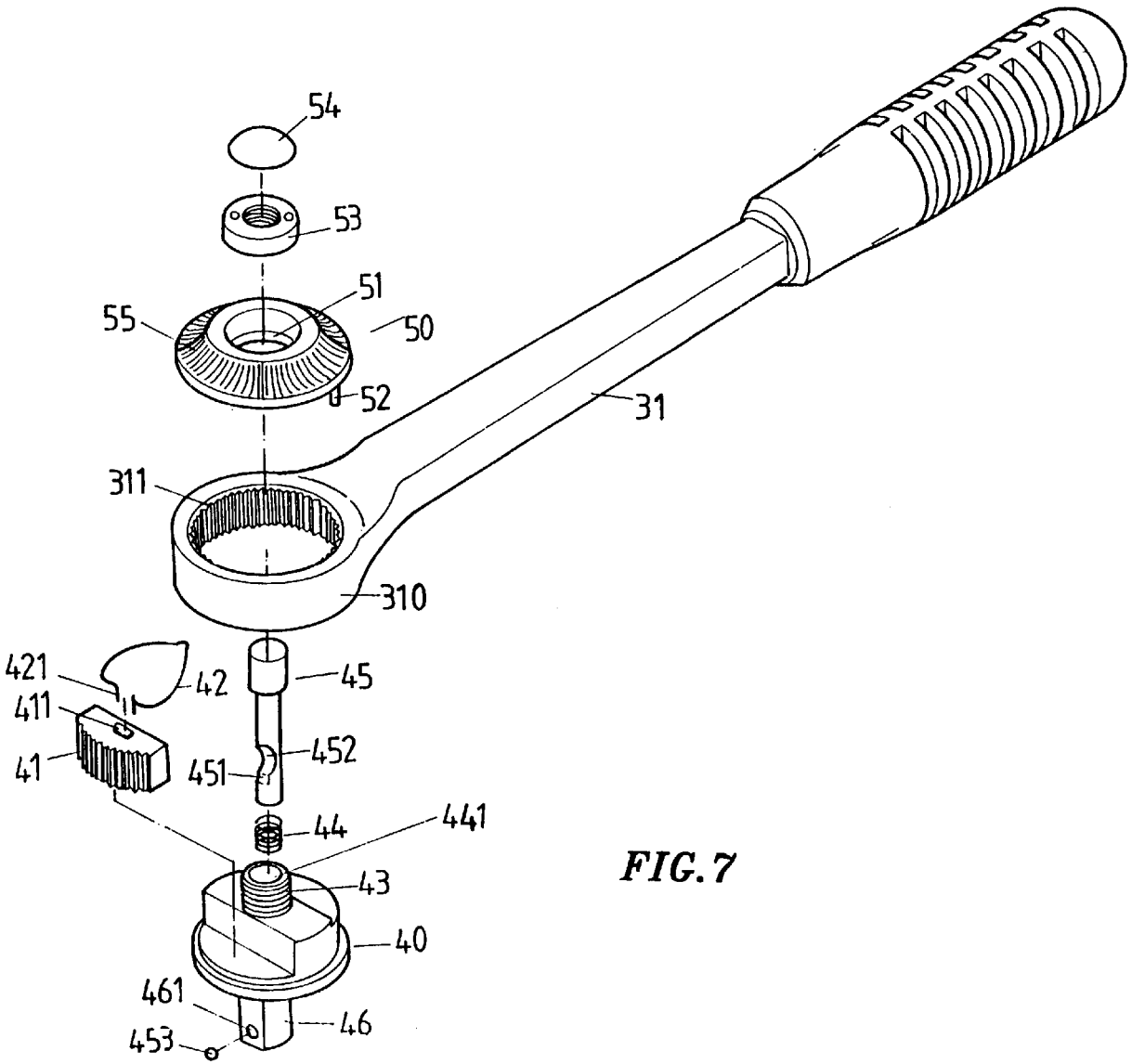
FIG. 7 is an exploded view of the present invention.
Figures 8, 8A, 8B:
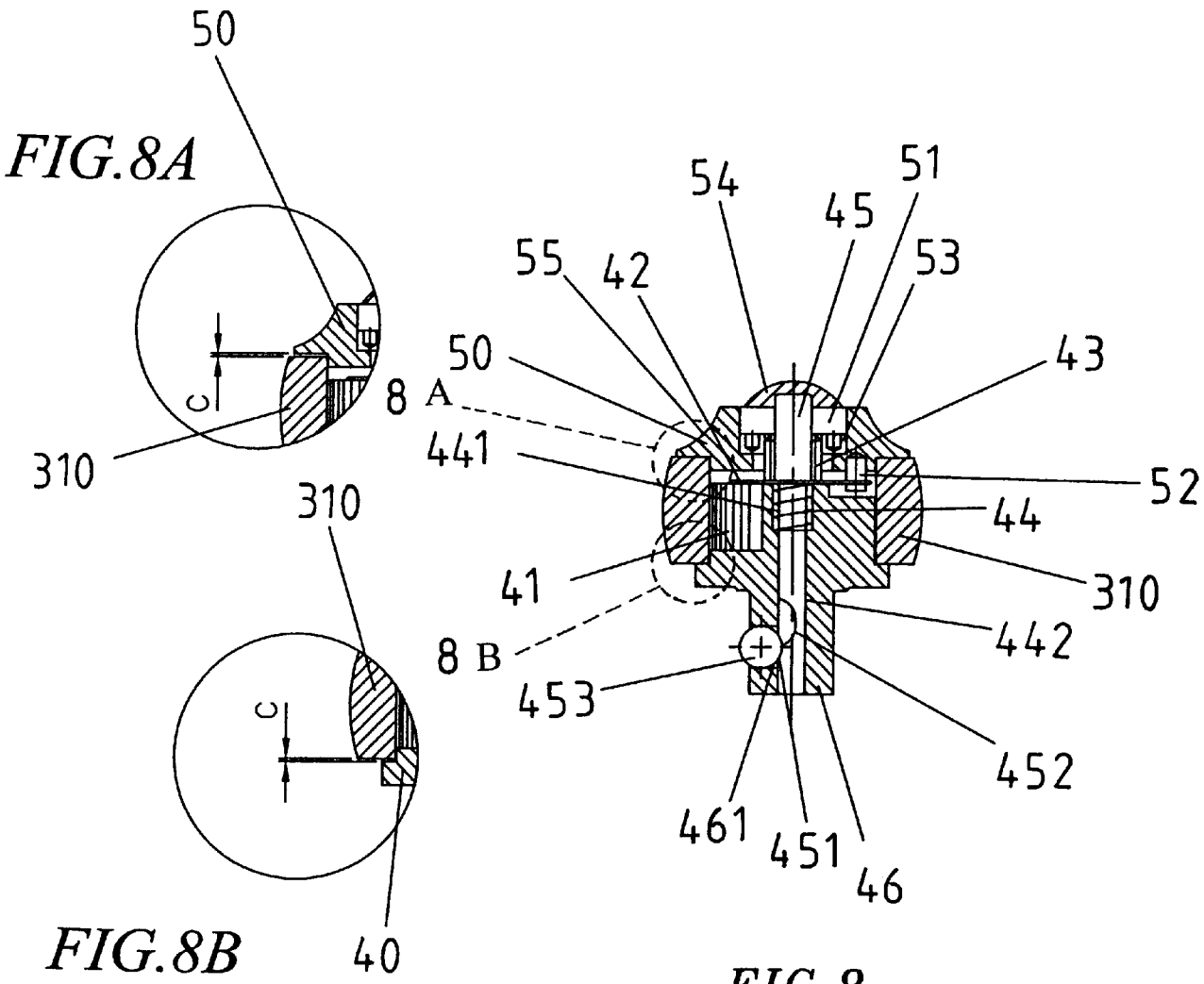
FIG. 8 is a front cross-section view of the present invention.
FIG. 8A and FIG. 8B are enlarged view of portions of FIG. 8.
Figure 9:
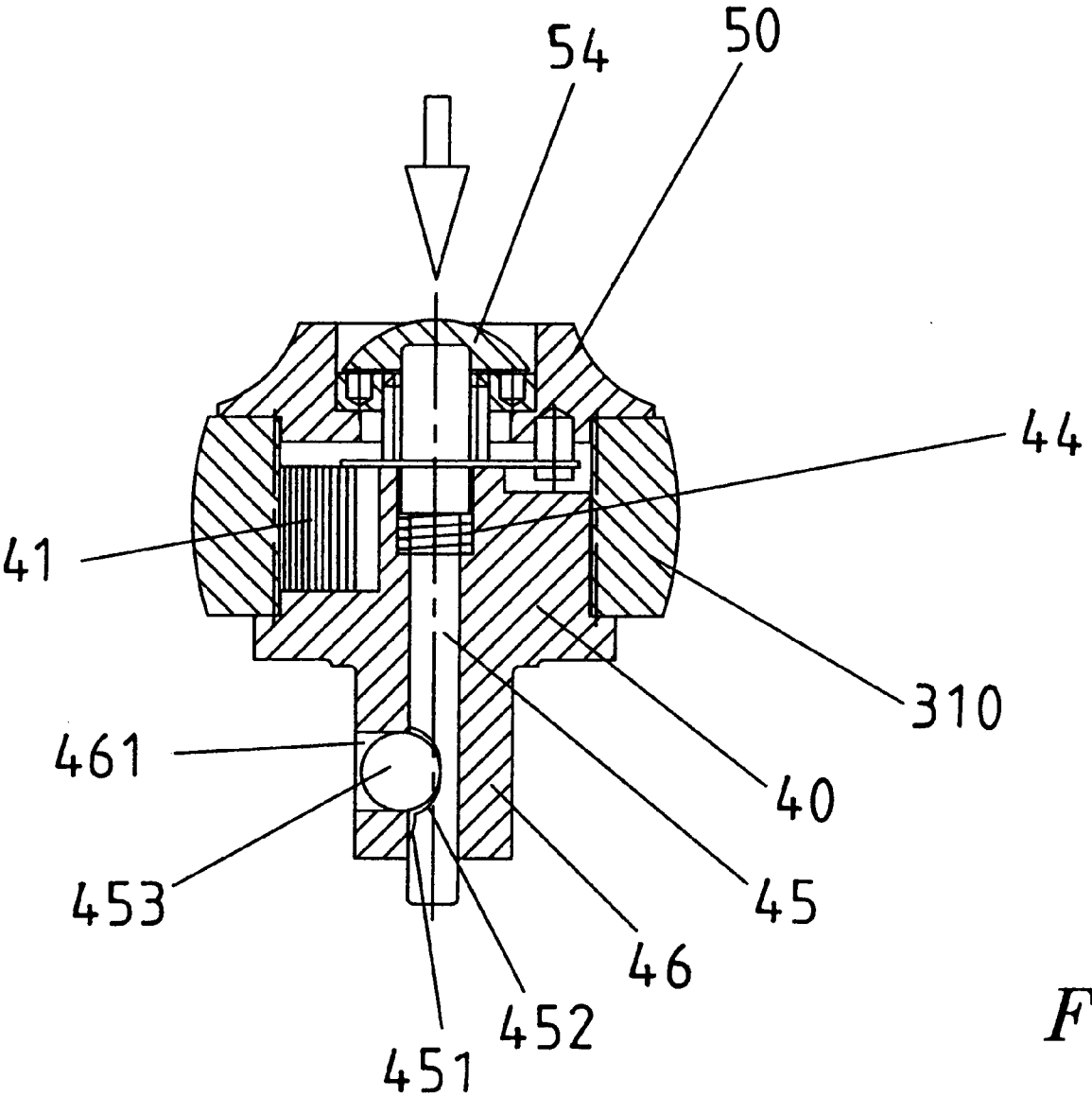
FIG. 9 is a front cross-section view showing the action of the present invention.
Figure 10:
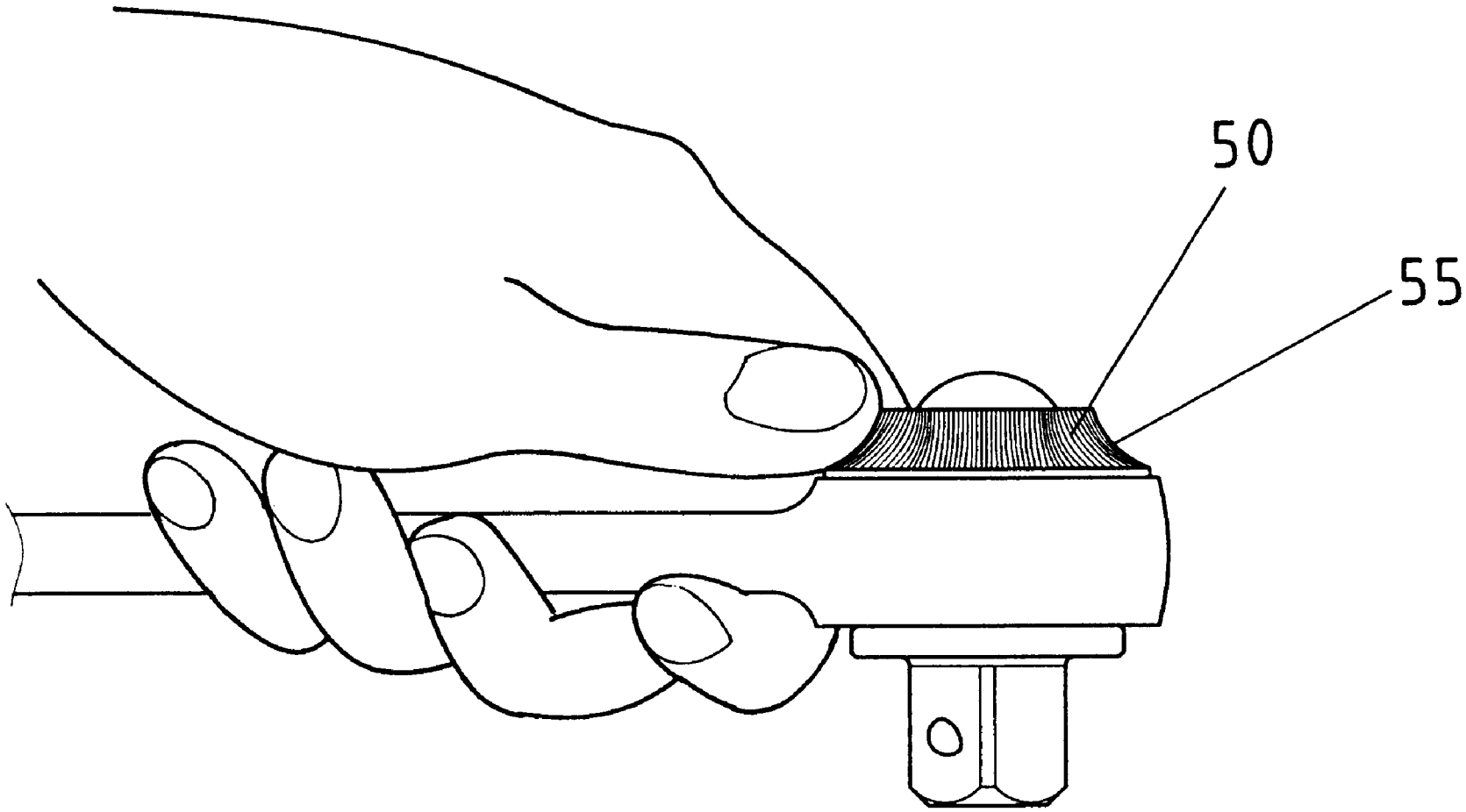
FIG. 10 is a schematic drawing showing use of the present invention.
Figure 11:
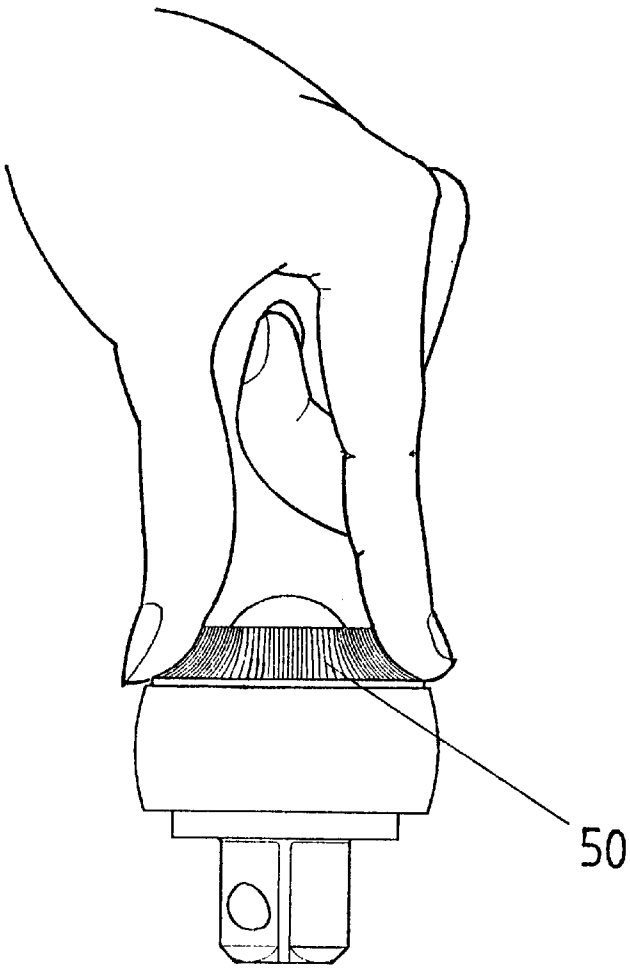
FIG. 11 is a schematic drawing showing a user operating the reversing disc of the present invention.
Figure 12:
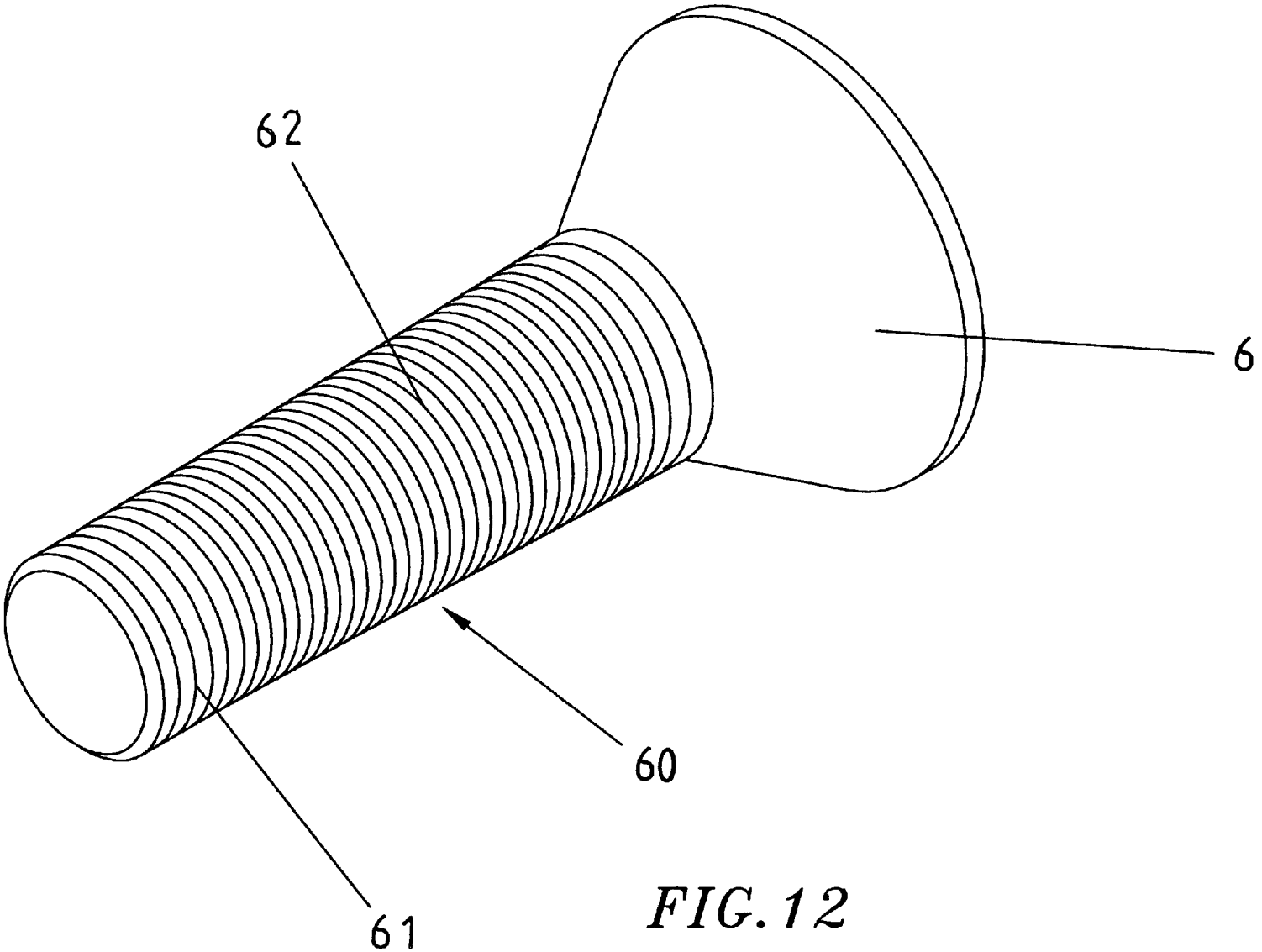
FIG. 12 is a perspective view showing the bolt of the present invention.
Figure 13:
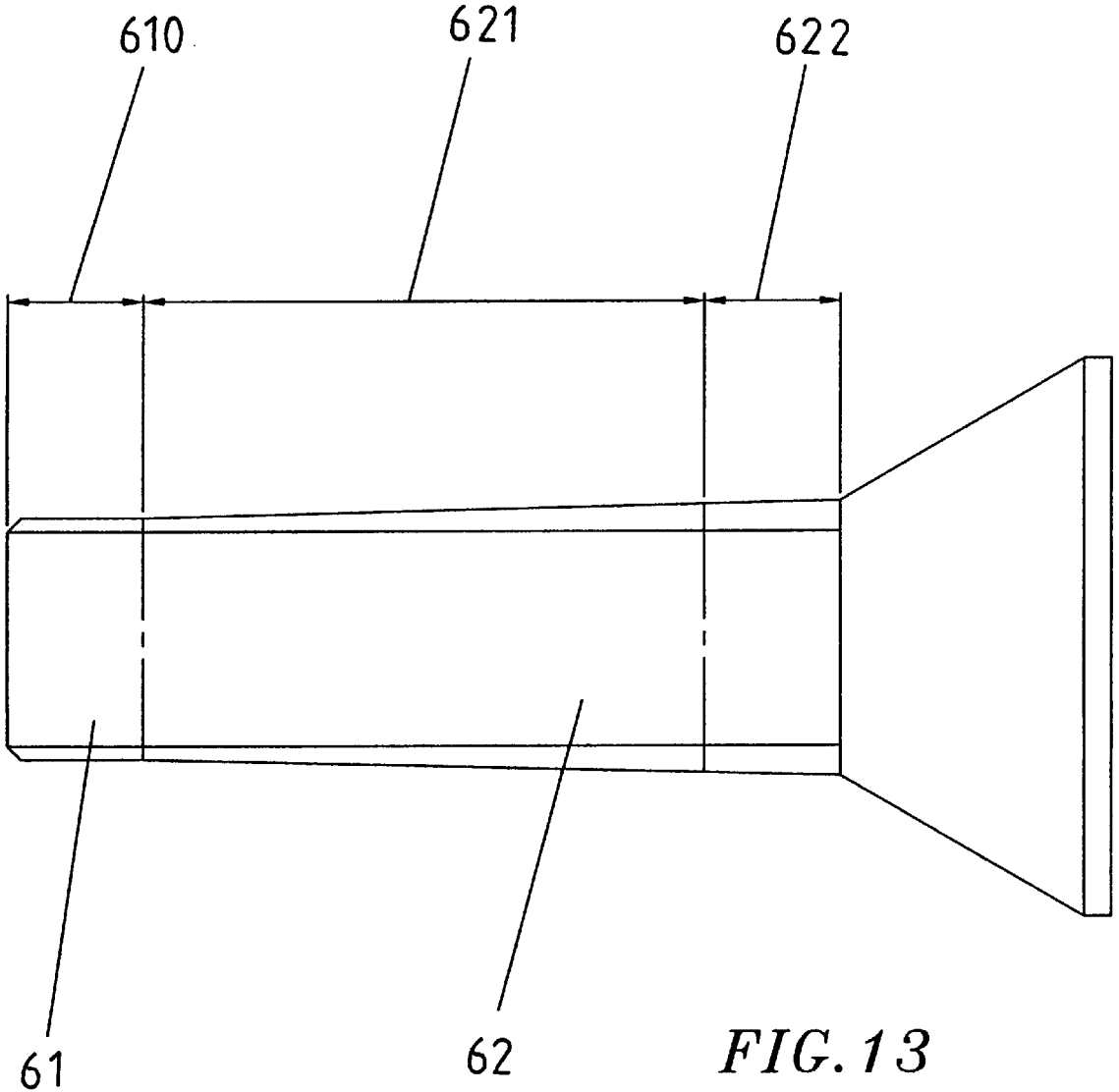
FIG. 13 is a side view showing the bolt of the present invention.

In the other situation, referring to FIG. 12 and FIG. 13, the present invention provides an improved bolting joint structure based on the above-mentioned conventional ratchet wrench as shown in FIG. 5. The present invention provides a bolt 6 instead of the conventional Teflon coated bolt 37. The thread trunk 60 of said bolt 6 consists of a straight segment 61 at the front portion and a conic segment 62 at the back portion, as a straight bolt connected to a conic bolt having a diameter that increases. The straight segment 61 is used as a guiding section 610 smaller in diameter than a normal bolt, and with a low dimensional accuracy so that it can be screwed into the threaded hole easily. The conic segment 62 includes a screwing section 621 and a securing section 622, wherein the diameter becomes the normal engaging dimension in the screwing section 621, then along with the increasing diameter of the screwing section 621, the threaded engagement is tightened until secured with the securing section 622.

Figure 14:
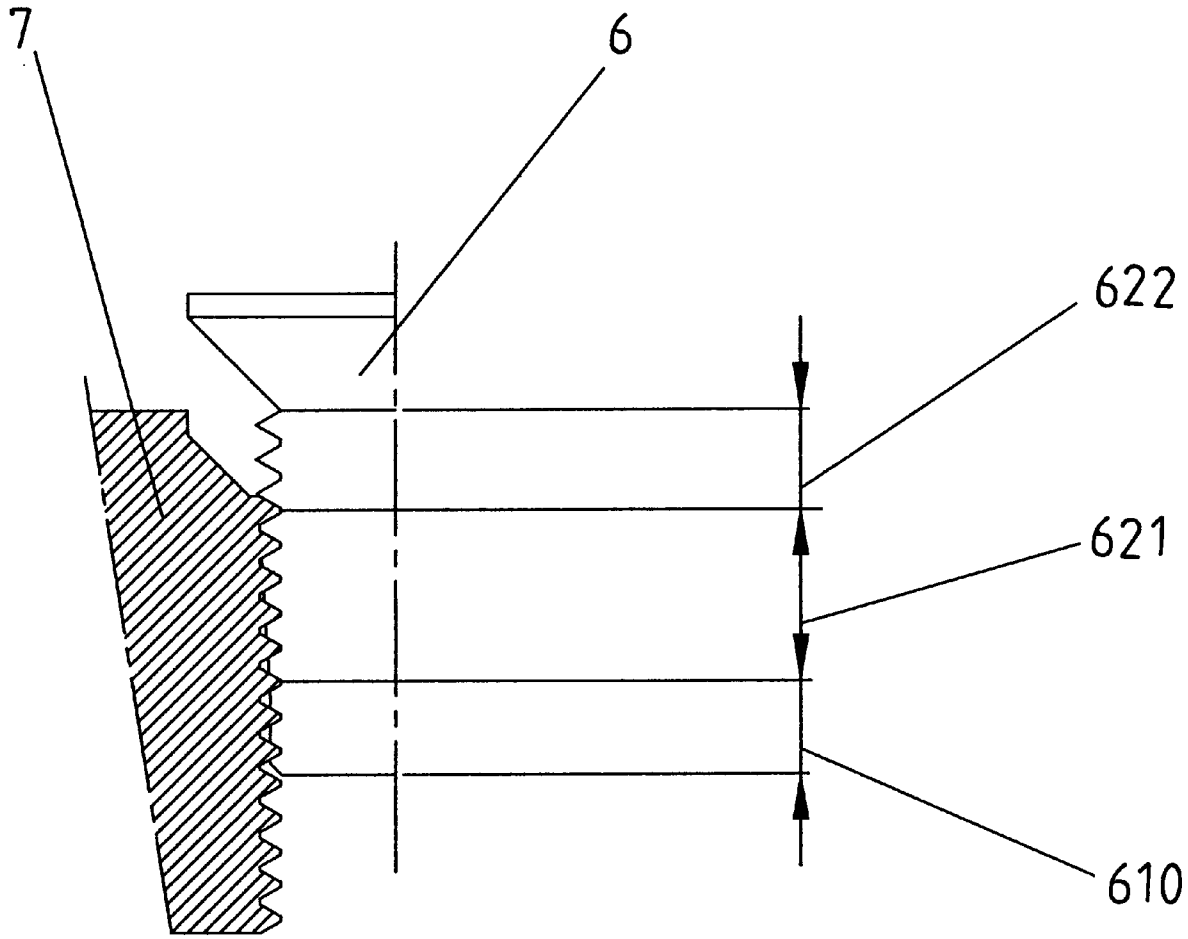
FIG. 14 is a partial cross-section view showing the meshing of the bolt of the present invention.

Referring to FIG. 14, the bolt 6 is threaded into the threaded hole 7. The guiding section 610, due to its smaller dimension, is easily screwed into the threaded hole 7, upon entering the screwing section 621, the radial dimensions of the threads do not interfere with each other in this section. But upon entering the securing section 622, a radial interference gradually occurs radially, meanwhile providing axial securement. The diameter of the threads of the screwing section gradually increase to a nominal size, while the diameter of the threads of the securing section continuously increases beyond the nominal size to form a tight joint.

Figures 15, 15A, 15B:
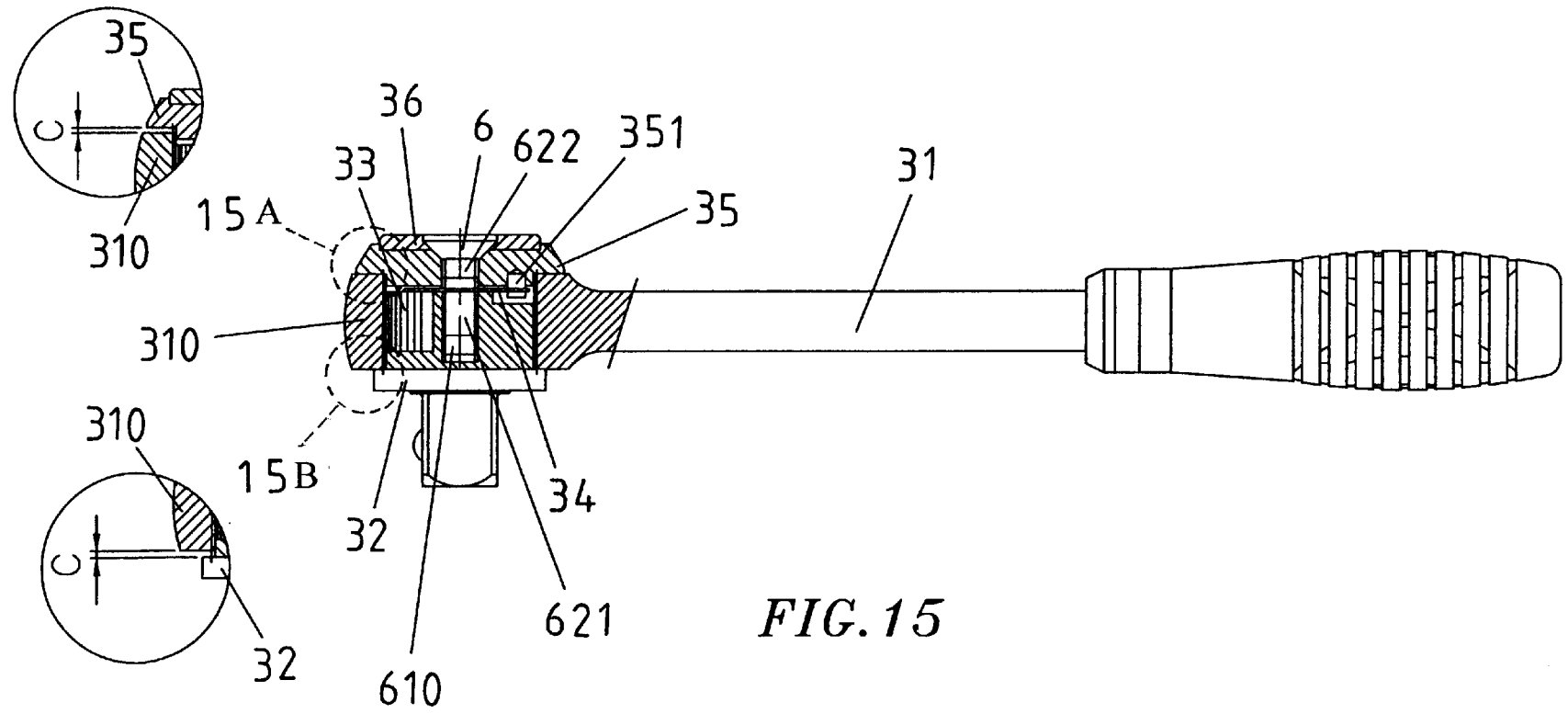
FIG. 15 is a partially sectioned view showing another operation of the present invention; and, FIG. 15A and FIG. 15B are enlarged views of portions of FIG. 15.

Therefore, the present invention has a radial and axial retaining effect. In assembly, referring to FIG. 15, FIG. 15A and FIG. 15B, the gap C is adjusted to a proper value so that the D-head 32 can swivel freely without any extra swaying. By arranging an appropriate number of washers 36, the bolt 60 can be secured into the threaded hole of the D-head 32. In this case, when turning the reversing disc 35, it can move independently of the other parts. Therefore, the ratchet wrench cannot be loosened by striking the wrench in use, and the desired gap C is kept efficiently small.

I claim:

1. A ratchet wrench comprising:

a main body having a head portion, said head portion having a through bore and a plurality of teeth formed in an inner wall surface thereof circumscribing said through bore;

a D-head rotatably disposed in said through bore and having plug joint portion formed on a first end and a threaded portion extending from a second end thereof, said D-head having a centrally disposed axially directed stepped hole formed therein and extending through said threaded portion, said plug joint portion having a ball housing formed by a laterally directed opening in open communication with said stepped hole;

a loose rachet disposed on said D-head and having slotted hole formed therein;

a cardioid spring having a pair of extension legs retained in said slotted hole of said loose ratchet;

a control rod slidingly disposed in said stepped hole, said control rod having a concave pushing face and ball seat respectively formed adjacent a distal end thereof;

a spring disposed in said stepped hole for upwardly biasing said control rod;

a ball disposed in said ball housing and contacting said pushing face partially extend from said ball housing, said control rod being displaceable to align said ball seat with said ball for displacement of said ball into said ball seat;

a reversing disc having a centrally disposed shouldered hole formed therethrough, said reversing disc being disposed on said head portion of said main body with said threaded portion of said D-head extending through said shouldered hole;

a circular nut disposed in said shouldered hole and threadedly engaged with said threaded portion of said D-head; and, a bonding agent inserted between said circular nut and said threaded portion of said D-head for affixing one to the other.

2. The ratchet wrench as recited in claim 1 where said reversing disc has a circular groove formed circumferentially therein, said circular groove having an arcuate cross-sectional contour with knurling formed on a surface thereof.

3. The ratchet wrench as recited in claim 2 further comprising an elastic cap coupled to a proximal end of said control rod for contact with a user's finger.

4. A ratchet wrench comprising:

a main body having a head portion, said head portion having a through bore and a plurality of teeth formed in an inner wall surface thereof circumscribing said through bore;

a D-head rotatably disposed in said through bore and having plug joint portion formed on a first end and a threaded hole formed in a second end thereof, said plug joint portion having a ball housing formed by a laterally directed opening formed in said plug joint;

a loose rachet disposed on said D-head and having slotted hole formed therein;

a cardioid spring having a pair of extension legs retained in said slotted hole of said loose ratchet;

a spring biased ball disposed in said ball housing and extending partially therefrom;

a reversing disc having a centrally disposed hole formed therethrough, said reversing disc being disposed on said head portion of said main body with said central hole disposed in aligned relationship with said threaded hole of said D-head;

a washer disposed on an upper surface of said reversing disc and having a through opening disposed in aligned relationship with said central hole; and, a screw extending through said through opening of said washer and said central hole of said reversing disc for threaded engagement with said threaded hole of said D-head, said screw having a screw head formed on one end thereof and a straight threaded portion formed on an opposing end of said screw, said screw having a conic threaded portion disposed between said straight threaded portion and said screw head for tight engagement with said threaded hole of said D-head.

5. The ratchet wrench as recited in claim 4 where said straight threaded portion defines a guiding section of said screw having a diameter smaller than said conic threaded portion, said conic threaded portion having (a) a screwing section with a diameter gradually increasing to a nominal value, and (b) a securing section with a diameter continuously increasing beyond the nominal value.

* * * * *